United States Patent [19]

Eberhart et al.

[11] Patent Number: 4,694,618

[45] Date of Patent: Sep. 22, 1987

[54] SANDING TOOL

[75] Inventors: Edward Eberhart, Northville, Mich.; Arlen E. Ingram, 32606 Barkley, Livonia, Mich. 48154

[73] Assignee: Arlen E. Ingram, Livonia, Mich.

[21] Appl. No.: 846,013

[22] Filed: Mar. 31, 1986

[51] Int. Cl.[4] ..... B24D 15/04

[52] U.S. Cl. ..... 51/392; 51/382; 51/395; 30/506; 30/510

[58] Field of Search ..... 51/358, 381, 382, 391, 51/392, 393, 394, 395, 397, 399; 30/506, 507, 508, 509, 510, 511, 512, 513

[56] References Cited

U.S. PATENT DOCUMENTS

| | | | |
|---|---|---|---|
| 804,514 | 11/1905 | Wysong | 51/395 |
| 833,569 | 10/1906 | Adamkiewitz | 30/510 |
| 1,087,648 | 2/1914 | Duffy | 30/511 |
| 1,474,210 | 11/1923 | Royle | 30/510 |
| 2,447,327 | 8/1948 | Gerrits et al. | 51/392 X |
| 2,769,469 | 11/1956 | Budniak | 30/506 |
| 2,944,574 | 7/1960 | Johnson | 30/506 |
| 3,874,126 | 4/1975 | Catlin | 51/393 |

*Primary Examiner*—Robert P. Olszewski

*Attorney, Agent, or Firm*—Barnes, Kisselle, Raisch, Choate, Whittemore & Hulbert

[57] ABSTRACT

A band-type abrasive strip and hand tool holder which utilizes the resilience of the holder to enable the band to be applied to the holder or removed and also the same resilience to maintain tension on the band. Modified holders allow difference size bands and a longitudinally split band allows transverse deformation to reach crevices and contours on a workpiece.

3 Claims, 9 Drawing Figures

80
94
88
90
86
42
44
40
9
82
78
84
8
92
74
70
76
72
89

SANDING TOOL

FIELD OF INVENTION

Hand tool holders for flexible sanding belts.

BACKGROUND AND OBJECTS OF THE INVENTION

Abrasive strip holders for sanding various objects have been the subject of numerous patents. Illustrative of these patents are the following United States patents:

| | |
|---|---|
| 604,895 | May 31, 1898 |
| 2,132,889 | Oct. 11, 1938 |
| 2,424,702 | July 29, 1947 |
| 2,447,327 | Aug. 17, 1948 |
| 3,648,418 | Mar. 14, 1972 |
| 3,699,729 | Oct. 24, 1972 |
| 3,871,141 | Mar. 18, 1975 |
| 3,874,126 | Apr. 1, 1975 |
| 4,314,426 | Feb. 9, 1982 |

It is an object of the present invention to provide a simplified holder for a sanding device which can be made essentially of one piece of wire or rod stock and which can utilize the inherent resilience of the holder to retain a loop of sanding material.

Other objects and features of the invention are to be found in the following description and claims in which the principles of the invention are described and details of the product and the method of forming are set forth to enable persons skilled in the art to utilize the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
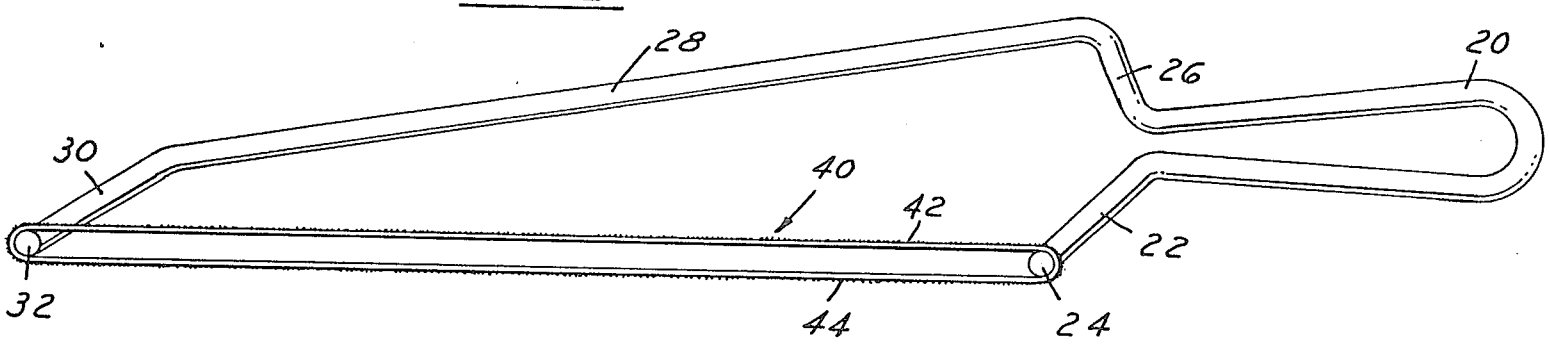
FIG. 1, a side profile of the holder.
Figure 2:
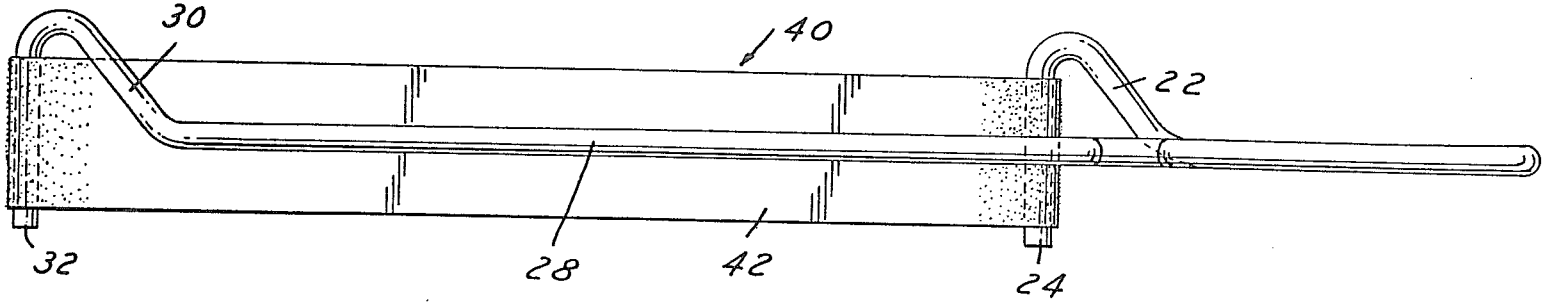
FIG. 2, a top view of the holder.

In FIG. 1, a one-piece rod or wire, preferably of spring steel with some resilience, is illustrated having a handle loop 20, the bottom run of which diverges to a leg 22 having a transverse extension 24 normal to the plane of the handle. The top run of the handle rises at 26 and slants downward at 28 in a low angle and then at a higher angle at 30 with a transverse extension 32, again normal to the plane of the handle and parallel to the extension 24.

The extensions 24 and 32 can be brought closer to each other by the resilience of the entire frame formed from the single run of rod. A loop 40 of abrasive material has a top run 42 and a bottom run 44 and has also a fixed diameter which is less than the distance between the extensions 24 and 32. Accordingly, when one end of the loop is placed over one extension, for example, 24, the other end can be placed over the other extension 32 only by deforming the frame to bring the extensions toward each other.

When the loop is installed, the tendency of the frame to return to its normal size will tension the loop 40. The abrasive band 40 can then be manipulated to sand any part and will conform to the contours of a part to which it is applied. It will be seen that loops may be removed and replaced in the same manner as above described utilizing the resilience of the frame.

Figure 3:
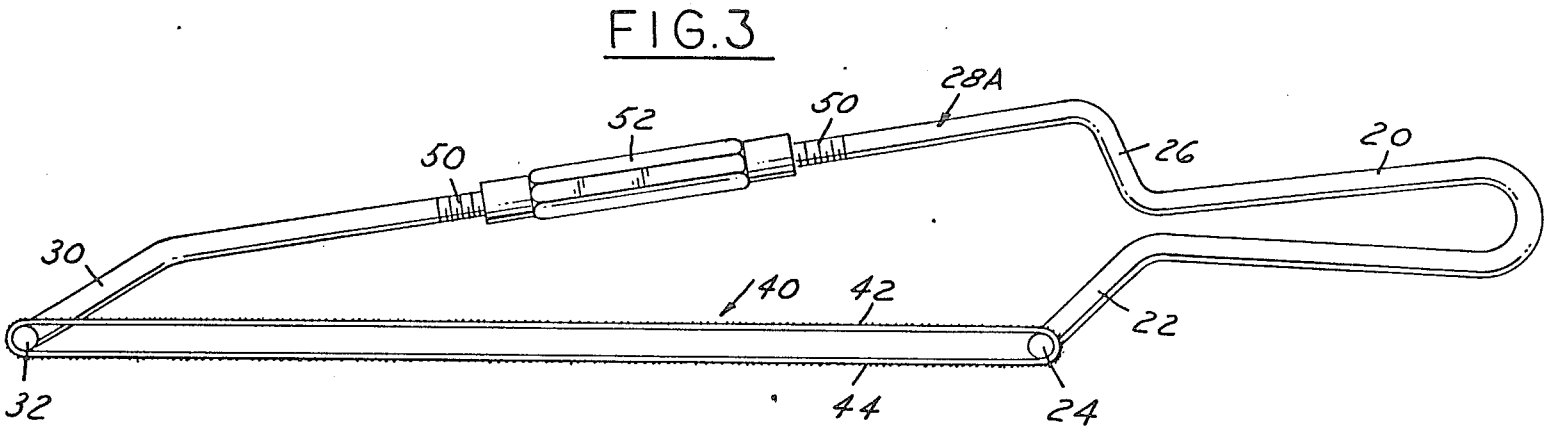
FIG. 3, a side view of a modified holder.

In FIG. 3, a modified frame is illustrated in which the run 28A is divided, the separated ends threaded at 50 and a turnbuckle applied between the separated ends to adjust the overall length of the frame. This permits the frame to utilize different size abrasive loops. The mounting and removal of the loops utilizing the resilience of the parts is still the same.

Figure 4:
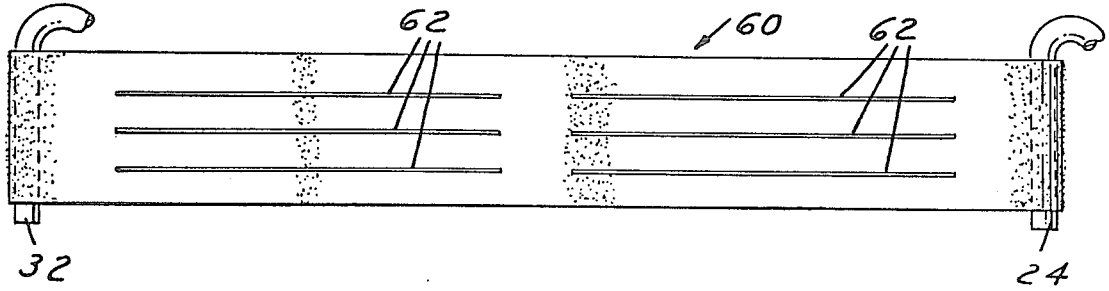
FIG. 4, a plan view of a modified sanding loop.
Figure 5:
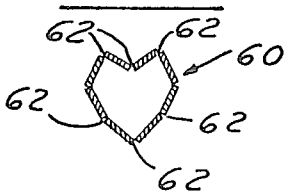
FIG. 5, a view of the modified loop in a working configuration.
Figures 6, 7, 8, 9:
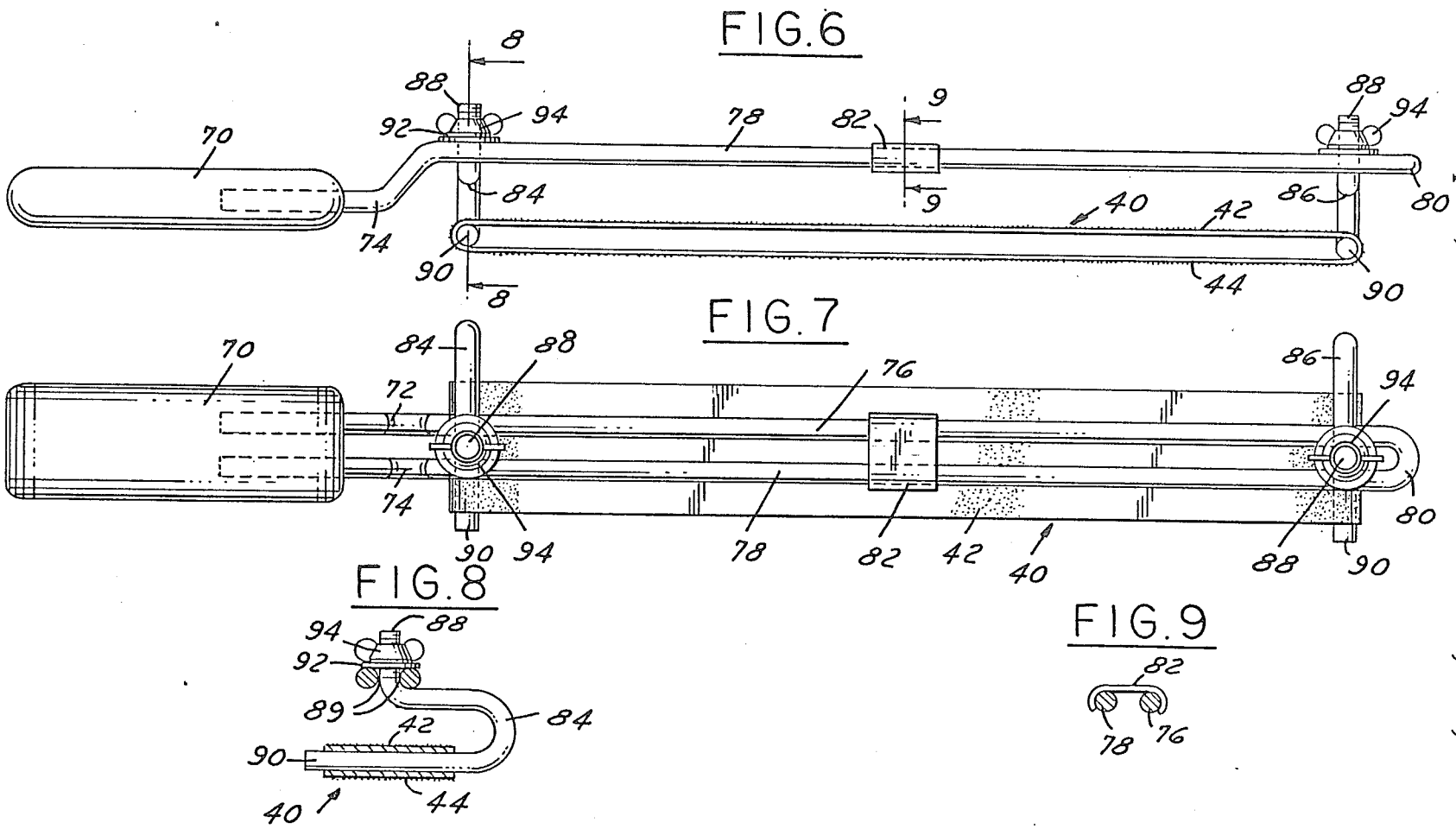
FIG. 6, a side view of a modified construction.
FIG. 7, a plan view of the modified construction of FIG. 6.
FIG. 8, a sectional view on line 8—8 of FIG. 6.
FIG. 9, a sectional view on line 9—9 of FIG. 6.

In FIG. 4, a modified abrasive loop 60 is illustrated. This loop has slits or cuts 62 extending longitudinally of the loop runs. When applied to a part, the abrasive strip can adapt more readily to grooves and indentations to take various shapes as shown, for example, in FIG. 5.

In FIGS. 6 to 9, a second modification is illustrated. In this unit, a handle 70 receives parallel ends 72, 74 of a straight run of parallel portions 76, 78 having a connecting bight 80. A small clip 82 holds the portions 76, 78 from spreading.

Two identical curved bracket elements 84, 86 are provided to form the abrasive loop retainers. A top extension 88 is threaded and provided with opposed flats 89 to lie between arms 76, 78. A lower extension 90 provides the loop retainers. A washer 92 and a thumb screw 94 allows the elements 84, 86 to be tightened into a proper position for a designated abrasive loop. Here again, once the brackets are adjusted for an abrasive loop of a particular size, the loops may be applied by utilizing the resilience of the runs 76, 78 to bring the extension 90 together so the loop can be applied and tensioned for use.

What is claimed is:

1. A manually operated sanding tool which comprises a support frame comprising a handle having embedded therein two proximal ends of a double run rod connected at the distal end by a bight portion, said runs being parallel and spaced apart in a plane, U-shaped loop supports having one leg provided with a right angle threaded extension to insert between and be clamped on said parallel runs, a threaded nut on each extension to clamp the supports to said parallel runs of said frame, and the other leg lying in spaced relation to said plane to provide longitudinally spaced loop supports, and a flat closed loop of abrasive material having each end of the loop respectively looped over said loop supports and retained in tension.

2. A tool as defined in claim 1 in which said abrasive loop has a plurality of longitudinal slits between the edges thereof to allow the loop to conform to irregular shapes.

3. A manually-operated sanding tool which comprises a resilient frame formed of a single piece of resilient rod including a handle portion formed of upper and lower diverging runs in a plane connected by a bight, a short riser from said upper handle run in said plane, a backrun in said plane extending from said riser to a distal end of said frame, a first angled portion diverging downward from said backrun at said distal end and away from said plane in one direction, a first return portion from said first angled portion extending from said first angled portion through and perpendicular to said plane, a second angled portion extending from said lower run of said handle downwardly and away from said plane in said one direction, and a second return portion from said second angled portion extending through and perpendicular to said plane and parallel to said first return portion, and a flat closed loop of abrasive material having each end of the loop respectively looped over said first and second return portions and retained in tension between said return portions of said frame.

* * * * *